US005712234A

United States Patent [19]

Pourreau

[11] Patent Number: 5,712,234

[45] Date of Patent: Jan. 27, 1998

[54] GRAFFITI REMOVERS WHICH COMPRISE A DYE BLEACHING AGENT

[75] Inventor: Daniel B. Pourreau, Downingtown, Pa.

[73] Assignee: Arco Chemical Technology, L.P., Greenville, Del.

[21] Appl. No.: 612,358

[22] Filed: Mar. 7, 1996

Related U.S. Application Data

[63] Continuation of Ser. No. 345,098, Nov. 28, 1994, abandoned.

[51] Int. Cl.[6] ..... C11D 7/54

[52] U.S. Cl. ..... 510/174; 510/212; 510/242; 510/371; 510/372; 510/380; 510/465

[58] Field of Search ..... 510/174, 212, 510/242, 371, 372, 375, 380, 465; 134/38

[56] References Cited

U.S. PATENT DOCUMENTS

| | | | |
|---|---|---|---|
| 3,673,099 | 6/1972 | Corby et al. | 510/206 |
| 3,915,880 | 10/1975 | Sepulveda | 510/369 |
| 4,329,247 | 5/1982 | Palmer | 510/244 |
| 4,716,056 | 12/1987 | Fox et al. | 421/407 |
| 4,767,564 | 8/1988 | Kitchens et al. | 510/206 |
| 4,780,235 | 10/1988 | Jackson | 510/212 |
| 4,812,255 | 3/1989 | Suwala | 510/202 |
| 4,836,950 | 6/1989 | Madsen et al. | 510/170 |
| 5,006,279 | 4/1991 | Grobbel et al. | 510/206 |
| 5,015,410 | 5/1991 | Sullivan | 510/208 |
| 5,024,780 | 6/1991 | Luys | 510/174 |
| 5,035,829 | 7/1991 | Suwala | 510/212 |
| 5,073,287 | 2/1991 | Havelstad | 510/202 |
| 5,215,675 | 6/1993 | Wilkins | 510/206 |
| 5,232,515 | 8/1993 | Sullivan | 510/208 |
| 5,290,365 | 3/1994 | Whitton | 134/38 |
| 5,334,331 | 8/1994 | Fusiak | 510/174 |
| 5,346,640 | 9/1994 | Lup | 510/174 |
| 5,413,729 | 5/1995 | Gaul | 510/206 |
| 5,454,985 | 10/1995 | Harbin | 134/38 |

FOREIGN PATENT DOCUMENTS

| | | |
|---|---|---|
| 2191501A | 12/1987 | United Kingdom . |
| WO8808445 | 11/1988 | WIPO . |

*Primary Examiner*—Paul Lieberman
*Assistant Examiner*—Caroline L. Dusheck
*Attorney, Agent, or Firm*—Jonathan L. Schuchardt

[57] ABSTRACT

Graffiti removers particularly useful for removing permanent ink from painted surfaces are disclosed. The graffiti removers include a dye solvent (a pyrrolidone or a lactone), a dye non-solvent (a glycol ether ester or a glycol diether), and a dye bleaching agent (an oxidizing agent, reducing agent, or base). The dye bleaching agent is the key to eliminating the problem of "ghosting" that is observed when conventional graffiti removers are used to remove permanent marker ink graffiti.

16 Claims, No Drawings

GRAFFITI REMOVERS WHICH COMPRISE A DYE BLEACHING AGENT

This is a continuation of application Ser. No. 08/345,098, filed Nov. 28, 1994, now abandoned.

FIELD OF THE INVENTION

The invention relates to compositions useful for removing graffiti, especially permanent ink graffiti, from painted surfaces. The graffiti removers of the invention are especially effective in eliminating the common problem of "ghosting" from permanent markers, which is caused by traces of ink that remain following surface treatment with a conventional graffiti remover.

BACKGROUND OF THE INVENTION

Blessings on all the kids who improve the signs in the subways . . .

So begins Edward Field's 1963 poem "Graffiti," a sarcastic tribute to the artist-vandals who vanish with the daylight, but leave behind perverse, permanent reminders of their nocturnal antics. A well-known urban problem then, graffiti continues to plague our landscape. Public rest rooms, schools, buses, subway cars, road signs, and bridges are just a few of the prime targets for the vandals.

General methods for dealing with graffiti generally fall into one of three categories: removal by an abrasive method (such as sandblasting), chemical removal, or repainting over the graffiti. These general methods were recently described in more detail by Leys in U.S. Pat. No. 5,346,640. As noted in the patent, each method has its disadvantages in terms of cost, labor, and environmental impact.

Permanent ink markers pose a special graffiti-removal problem. Unlike spray paint, permanent ink penetrates the surface of the paint, so that even after surface ink has been removed, a residue or "ghost" remains. In addition, many traditional ink removers contain chemicals that are flammable, toxic, or attack the painted surface. For example, methylene chloride is a potent ink remover, but is a cancer-suspect agent and an aggressive paint stripper. Xylene and toluene, which are common albeit rather ineffective ink remover components, are highly volatile and flammable..

Leys (U.S. Pat. No. 5,346,640) describes graffiti removers based on N-methyl-2-pyrrolidone, propylene carbonate, isocetyl alcohol, a glycol ether ester, a surfactant, and a thickener. The reference teaches that the compositions are useful for removing marking pen inks. The reference does not specifically address the problem of ghosting.

Still needed in the art are graffiti removers that will effectively remove permanent inks and dyes from painted surfaces. Particularly needed are formulations that will eliminate ghosting. An ideal graffiti remover would be water-rinsable, biodegradable, and less hazardous to use than methylene chloride or volatile hydrocarbons.

SUMMARY OF THE INVENTION

The invention is an improved graffiti remover that is particularly effective for removing permanent ink markings from painted surfaces. The graffiti remover comprises from about 20 to about 60 wt. % of a dye solvent selected from pyrrolidones and lactones, from about 40 to about 80 wt. % of a dye non-solvent selected from glycol ether esters and glycol diethers, and from about 0.1 to about 10 wt. % of a dye bleaching agent. The dye bleaching agent, which is the key to eliminating ghosting, is a compound that will react with an azo dye, and includes oxidizing agents, reducing agents, and bases.

Graffiti removers containing a dye solvent and a dye non-solvent are fairly effective in removing permanent ink from painted surfaces; however, in the absence of a bleaching agent, these formulations still leave a visible ghost following treatment. I have now discovered that the ghost can be eliminated by including an effective amount of a bleaching agent in the graffiti remover.

The graffiti removers of the invention are water-soluble and biodegradable. In addition, the major components typically have relatively low toxicity and low volatility, making these removers less hazardous to use than conventional graffiti removers that contain methylene chloride, toluene, or xylenes.

DETAILED DESCRIPTION OF THE INVENTION

The graffiti removers of the invention comprise a dye solvent, a dye non-solvent, and a dye bleaching agent. Optionally, other components are also included, particularly thickeners, surfactants and the like.

The dye solvent attacks and dissolves the graffiti. The dye solvent is a pyrrolidone or a lactone. Preferred pyrrolidones are N-alkyl-2-pyrrolidones in which the alkyl group is a $C_1$–$C_5$ alkyl group. Examples include N-methyl-2-pyrrolidone, N-ethyl-2-pyrrolidone, and the like, and mixtures thereof. N-methyl-2-pyrrolidone is preferred. Lactones are also suitable, particularly γ-butyrolactone and substituted γ-butyrolactones. γ-Butyrolactone is preferred. Mixtures of lactones and pyrrolidones can be used.

The amount of dye solvent used in the graffiti removers of the invention is generally within the range of about 20 to about 60 wt. %. A more preferred range is from about 30 to about 50 wt. %; most preferred is the range from about 35 to about 45 wt. %.

The graffiti removers contain a dye non-solvent, which protects the paint layer from attack by the dye solvent. Dye non-solvents useful in the invention include glycol ether esters and glycol diethers, preferably those having a flash point greater than about 150° F.

Suitable glycol ether esters are derived from $C_1$–$C_5$ ethers of $C_1$–$C_{10}$ glycols and $C_1$–$C_6$ carboxylic acids. Preferred glycol ether esters are glycol ether acetates, including, for example, acetate esters of ethylene glycol ethers, propylene glycol ethers, diethylene glycol ethers, dipropylene glycol ethers, tripropylene glycol ethers, and the like, and mixtures thereof. Suitable glycol ether esters include, but are not limited to, propylene glycol methyl ether acetate, dipropylene glycol methyl ether acetate, dipropylene glycol ethyl ether acetate, and the like, and mixtures thereof. Dipropylene glycol methyl ether acetate is particularly preferred.

The dye non-solvent can also be an glycol diether. Preferred glycol diethers are $C_1$–$C_4$ diethers of $C_2$–$C_6$ glycols. Examples include, but are not limited to, propylene glycol dimethyl ether, propylene glycol methyl t-butyl ether, dipropylene glycol dimethyl ether, dipropylene glycol methyl ethyl ether, and the like, and mixtures thereof. Preferred glycol diethers have good solubility in water.

The amount of dye non-solvent used in the graffiti removers of the invention is generally within the range of about 40 to about 80 wt. %. A more preferred range is from about 50 to about 70 wt. %; most preferred is the range from about 55 to about 65 wt. %.

The key component of the graffiti removers of the invention is a dye bleaching agent. While typical dye solvent/dye non-solvent blends are generally effective in removing surface graffiti, some kinds of markings, especially those made with permanent ink markers, penetrate painted surfaces more deeply, making complete elimination of the marks difficult. The bleaching agent eradicates traces of visible dye (ghosts) that typical graffiti removers usually leave behind. The bleaching agents used in the graffiti removers of the invention are compounds that react with azo dyes, and include oxidizing agents, reducing agents, and bases.

Suitable oxidizing agents are those that can deliver singlet oxygen. These oxidizing agents apparently react with azo compounds to give azoxy compounds or other products that are less highly conjugated than azo compounds; the reaction renders the markings invisible. Generally preferred oxidizing agents include hypochlorites, persulfates, perbenzoates, inorganic peroxyacids, organic and inorganic peroxides, percarbonates, peracids, and the like. Combinations of compounds that will generate singlet oxygen in situ can also be used, for example, an alkyl hydroperoxide and a transition-metal activator (e.g., Mo, V, Ti). Specific examples of suitable oxidizing agents include, but are not limited to, sodium hypochlorite, potassium hypochlorite, ammonium persulfate, sodium perbenzoate, perbenzoic acid, m-chloroperoxybenzoic acid, and the like, and mixtures thereof. Hypochlorites are particularly preferred.

Reducing agents are also effective as dye bleaching agents in the graffiti removers of the invention. Suitable reducing agents are generally traditional hydride (H-) sources. Preferred reducing agents include main group and transition metal hydrides. Examples include sodium hydride, potassium hydride, calcium hydride, sodium borohydride, zinc/HCl mixtures, and the like, and mixtures thereof. Because it is easy to handle and performs well, sodium borohydride is particularly preferred. Also suitable as bleaching agents are hydrosulfite salts, such as sodium hydrosulfite. Hydrosulfites are available from Olin Chemicals under the REDUCTONE trademark, or from Hoechst Celanese under the VIRTEX D trademark.

Bases are also effective dye bleaching agents in the invention. Suitable bases are strong inorganic bases such as alkali metal or alkaline earth metal hydroxides, alkoxides, or the like. Examples include sodium hydroxide, lithium hydroxide, potassium methoxide, calcium hydroxide, sodium ethoxide, and the like, and mixtures thereof. Bases are preferred dye bleaching agents because base-containing graffiti removers can generally be stored on a long-term basis.

The dye bleaching agent must be selected carefully. It should not react with the dye solvent, dye non-solvent, or other components of the graffiti remover. For some bleaching agents, storage stability may be an issue. For example, hydrides can react with graffiti remover components that contain active hydrogen atoms (e.g., hydroxyl group-containing surfactants) to generate hydrogen gas. If a hydride bleaching agent is used, precautions should be taken to avoid accumulating hydrogen gas in the graffiti remover. Storage of graffiti removers that contain hydrides should be avoided. Generally, it is preferred to use the graffiti removers immediately or soon after combining the dye bleaching agent with the other components.

The amount of dye bleaching agent used is an amount effective to eliminate ghosting. The exact amount needed to achieve the desired effect will depend upon many factors, including which dye solvent and dye non-solvent are used, the relative amounts of the dye solvent and dye non-solvent, which dye bleaching agent is used, the nature of the permanent markings to be removed, the nature of the surface to be treated, and other factors. Preferably, the minimum amount of bleaching agent needed to eliminate ghosting is used. Generally, it is preferred to use an amount of dye bleaching agent within the range of about 0.1 to about 10 wt. %. A more preferred range is from about 0.5 to about 5 wt. %; most preferred is the range from about 1 to about 3 wt. %.

The graffiti removers of the invention preferably include a surfactant. The surfactant improves wetting of the treated surface, helps the other components penetrate the marked surface, and increases the solution stability of the graffiti remover. In addition, the surfactant helps to emulsify non-water soluble components (including removed inks) during rinsing of the surface with water. Suitable surfactants include, but are not limited to, ethoxylated alkylphenols, ethoxylated aliphatic and aromatic alcohols, alkali metal salts of $C_8$–$C_{12}$ aliphatic sulfates, alkali metal salts of alkyl aromatic sulfonates, dialkyl sulfosuccinates, and the like. Ethoxylated alkylphenols, such as TRITON X-100 (product of Union Carbide), are preferred. The surfactant is used in an amount up to about 10 wt. % of the graffiti remover, preferably from about 0.1 to about 5 wt %.

A thickener is optionally included in the graffiti removers of the invention to control rheological properties of the remover. Suitable thickeners include, but are not limited to, alkylated, esterified, and oxyalkylated cellulose derivatives (e.g., ethyl cellulose, hydroxypropyl cellulose, and the like), organoclays, fatty acid salts, fumed silica, paraffinic waxes, polyvinyl alcohol, polyvinyl chloride, polystyrene, and the like. Hydroxypropyl cellulose thickeners, such as KLUCEL-H (product of Aqualon), are preferred.

The amount of thickener to be used depends on the how the graffiti remover is to be applied and on the desired viscosity. Typically, the thickener is used in an amount up to about 10 wt. % of the graffiti remover. Preferably, the amount used is within the range of about 0.1 to about 5 wt. %.

The graffiti removers optionally contain other conventional additives, including co-solvents, accelerators, and the like, in amounts effective to improve compatibility, optimize cost, or improve ink removal times.

The graffiti removers of the invention are conveniently prepared by combining the dye solvent, dye non-solvent, dye bleaching agent, and any optional surfactants, thickeners, or other additives, and blending the components well to give a uniform mixture.

The graffiti remover is applied to the marked surface by any suitable means, including brushing, rolling, or spraying. Sprayable formulations are generally preferred because graffiti-covered surfaces must usually be treated on location.

The graffiti remover and marked surface are allowed to remain in contact for a time effective to give complete or nearly complete graffiti removal. Removal is typically complete within minutes of application. Repeated applications can be used, but are usually not necessary. After application, the graffiti remover is typically rinsed from the surface with water or is wiped away with a wet sponge or cloth.

The graffiti removers can be used to treat a variety of types of painted and unpainted surfaces, including, for example, wood, metal, concrete, stone, glass, and some plastics. The removers are particularly effective in removing graffiti, including permanent ink, from painted surfaces without harming the painted surface.

The graffiti removers have additional advantages. In contrast to conventional products that contain methylene chloride or aromatic hydrocarbons, the removers of the invention are biodegradable, water rinsable, and generally have high flash points, and are less likely to release harmful vapors. Methylene chloride-based removers are also unsuitable for removing graffiti from painted surfaces because they will remove not only the graffiti, but also the underlying coatings.

A particularly effective graffiti remover of the invention is prepared by combining N-methyl-2-pyrrolidone (37 wt. %), dipropylene glycol methyl ether acetate (58 wt. %), sodium borohydride (2 wt. %), TRITON X-100 surfactant (2 wt. %), and KLUCEL-H thickener (1–2 wt. %). The remover is used immediately after preparation and is not stored because of the hydride bleaching agent. This remover is especially effective in removing permanent ink markings from painted metal without leaving behind a ghost.

The following examples merely illustrate the invention. Those skilled in the art will recognize many variations that are within the spirit of the invention and scope of the claims.

EXAMPLE 1

Permanent Ink Graffiti Removal: Effect of Bleaching Agent on "Ghosting"

Aluminum panels (4"×8") are coated with a white, two-part epoxy polyamide paint (from DL Industries). The painted panels are then marked with permanent ink using Sharpie permanent markers (green, blue, black, red). The ink is allowed to dry for 5 min., and the panel is then treated with a graffiti remover which contains: N-methyl-2-pyrrolidone (37 wt. %), dipropylene glycol methyl ether acetate (58 wt. %), a bleaching agent (2.0 wt. %, see Table 1 ), TRITON X-100 surfactant (2.0 wt. %, product of Union Carbide), and KLUCEL-H thickener (1.0 wt. %, product of Aqualon). A control sample omits the bleaching agent. [Note: Hydride-containing graffiti removers can generate hydrogen gas and should be used immediately after preparation. Storage should be avoided.]

The solutions are left on the panels for 3 min., and the panels are then rinsed with water. Ink removal is rated on a scale from 0 to 5 (see Table 2) for each color ink (5=total removal, 0=no ink removed). The total score for each graffiti remover is the average score for all four ink colors multiplied by 2. Thus, a sample that scores 4.5, 5.0, 5.0, 4.0 on the markings receives a total ink removal score of 2×[(4.5+5.0+5.0+4.0)/4]=9.3.

The results (Table 1 ) indicate that permanent ink graffiti removal is significantly improved by the presence of the bleaching agent. Unless a bleaching agent is included, ghosting remains a problem, even with an effective dye solvent/non-solvent system such as N-methyl-2-pyrrolidone/dipropylene glycol methyl ether acetate. The examples show that a variety of types of bleaching agents may be used, including oxidizing agents, reducing agents, and bases.

TABLE 1

Permanent Ink Graffiti Removal.
Effect of Dye Bleaching Agents on Ghosting

| Ex. # | Bleaching agent | Score for removal of permanent ink: Green | Blue | Black | Red | Score |
|---|---|---|---|---|---|---|
| 1 | $NaBH_4$* | 5.0 | 5.0 | 5.0 | 4.8 | 9.9 |
| 2 | KOH | 5.0 | 5.0 | 5.0 | 4.5 | 9.8 |
| 3 | NaOCl | 4.5 | 5.0 | 5.0 | 4.0 | 9.3 |
| C4 | none | 3.0 | 5.0 | 4.5 | 3.0 | 7.8 |

Substrate: Epoxy polyamide paint on aluminum.
Formulation: N-methyl-2-pyrrolidone (37 wt. %), dipropylene glycol methyl ether acetate (58 wt. %), bleaching agent (2.0 wt. %), TRITON X-100 surfactant (2 wt. %), KLUCEL-H thickener (1 wt. %).
Test method: See Example 1.
*Note: Hydride-containing graffiti removers should be used immediately after preparation to avoid accumulation of hydrogen gas. Storage should be avoided.

TABLE 2

Ink Removal Rating Scale

| Score | Removal of surface ink | Ghosting |
|---|---|---|
| 0 | none | strong |
| 1 | minimal | strong |
| 2 | substantial | strong |
| 3 | complete | strong |
| 4 | complete | weak |
| 5 | complete | none |

The preceding examples are meant only as illustrations. The following claims define the scope of the invention.

I claim:

1. A graffiti remover which comprises:
   (a) from about 20 to about 60 wt. % of a dye solvent selected from the group consisting of pyrrolidones and lactones;
   (b) from about 40 to about 80 wt. % of a dye non-solvent selected from the group consisting of glycol ether esters and glycol diethers; and
   (c) from about 0.1 to about 10 wt. % of a dye bleaching agent selected from the group consisting of main group metal hydrides, transition metal hydrides, and alkali metal hydrosulfites.

2. The graffiti remover of claim 1 further comprising up to about 10 wt. % of a thickener.

3. The graffiti remover of claim I further comprising up to about 10 wt. % a surfactant.

4. The graffiti remover of claim 1 wherein the dye solvent is selected from the group consisting of N-methyl-2-pyrrolidone, γ-butyrolactone, and mixtures thereof.

5. The graffiti remover of claim 1 wherein the dye non-solvent is dipropylene glycol methyl ether acetate.

6. The graffiti remover of claim 1 wherein the dye bleaching agent is an alkali metal borohydride.

7. The graffiti remover of claim I comprising from about 30 to about 50 wt. % of the dye solvent, from about 50 to about 70 wt. % of the dye non-solvent, and from about 0.5 to about 5 wt. % of the dye bleaching agent.

8. A graffiti remover which comprises:
   (a) from about 20 to about 60 wt. % of a dye solvent selected from the group consisting of N-methyl-2-pyrrolidone, γ-butyrolactone, and mixtures thereof;
   (b) from about 40 to about 80 wt. % of a dye non-solvent selected from the group consisting of glycol ether acetates and $C_1$–$C_4$ diethers of $C_2$–$C_6$ glycols; and (c) from about 0.1 to about 10 wt. % of a dye bleaching agent selected from the group consisting of main group metal hydrides, transition metal hydrides, and alkali metal hydrosulfites.

9. The graffiti remover of claim 1 further comprising up to about 10 wt. % of a thickener.

10. The graffiti remover of claim 8 further comprising up to about 10 wt. % a surfactant.

11. The graffiti remover of claim 8 wherein the dye bleaching agent is an alkali metal borohydride.

12. A method which comprises applying to a graffiti-marked surface the graffiti remover of claim 1 in an amount effective to allow subsequent removal of the graffiti from the surface.

13. A method which comprises removing permanent ink graffiti from a painted surface without substantially altering the surface and without leaving behind a graffiti ghost by treating the surface with a graffiti remover which comprises:

(a) from about 20 to about 60 wt. % of a dye solvent selected from the group consisting of pyrrolidones and lactones;

(b) from about 40 to about 80 wt. % of a dye non-solvent selected from the group consisting of glycol ether esters and glycol diethers; and (c) from about 0.1 to about 10 wt. % of a dye bleaching agent selected from the group consisting of (1) a reducing agent selected from the group consisting of main group metal hydrides, transition metal hydrides, and alkali metal hydrosulfites; and (2) an oxidizing agent selected from the group consisting of hypochlorites, persulfates, perbenzoates, inorganic peroxyacids, percarbonates, and peracids.

14. The method of claim 13 wherein the graffiti remover comprises from about 30 to about 50 wt. % of the dye solvent, from about 50 to about 70 wt. % of the dye non-solvent, and from about 0.5 to about 5 wt. % of the dye bleaching agent.

15. The method of claim 13 wherein the dye solvent is N-methyl-2-pyrrolidone, the dye non-solvent is dipropylene glycol methyl ether acetate, and the bleaching agent is sodium borohydride.

16. The method of claim 13 wherein the graffiti and graffiti remover are rinsed from the treated surface with water.

* * * * *